United States Patent [19]

Morgan et al.

[11] 4,120,740

[45] Oct. 17, 1978

[54] TAPE APPLICATOR FOR DRAPERY TABLER

[76] Inventors: Ronald Wade Morgan, 9509 Tiverton Way, Louisville, Ky. 40222; David Lane Witherspoon, 2104 Evergreen Rd., Anchorage, Ky. 40223

[21] Appl. No.: 744,646

[22] Filed: Nov. 24, 1976

[63] Continuation-in-part of Ser. No. 648,166, Jan. 12, 1976, Pat. No. 3,996,083, which is a continuation-in-part of Ser. No. 505,619, Sep. 13, 1974, abandoned.

[51] Int. Cl.[2] ..... B32B 31/00

[52] U.S. Cl. ..... 156/522; 38/104; 156/361; 156/523; 156/578

[58] Field of Search ..... 156/301, 522–523, 156/578, 584, 443; 38/104; 223/27, 28, 38

[56] References Cited

U.S. PATENT DOCUMENTS

| | | | |
|---|---|---|---|
| 2,276,958 | 3/1942 | Goldsmith | 156/522 |
| 2,387,631 | 10/1945 | Weir | 156/578 X |
| 3,077,919 | 2/1963 | Krueger | 186/584 |
| 3,439,438 | 4/1969 | Tuskos | 38/104 |
| 3,738,007 | 6/1973 | Tuskos | 38/104 X |
| 3,802,609 | 4/1974 | Benedetto | 156/443 X |
| 3,939,034 | 2/1976 | Tanaka et al. | 156/522 |
| 3,988,192 | 10/1976 | Landis | 156/522 X |

*Primary Examiner*—David A. Simmons

[57] ABSTRACT

This invention describes a process for applying a reinforcing or stiffening tape such as buckram or Pellon (registered trademark of the Pellon Corporation, New York, N.Y.) to a panel of drapery or other material directly, without the necessity of pre-marking, measuring or stitching. This is accomplished by the step of adhesively bonding the strip of reinforcing tape near the bottom edge of a panel suspended from the opposite end. Thereafter, the panel and the reinforcing strip adhesively secured thereto, is folded over itself and the reinforcing tape sandwiched between the two layers of panel and secured thereto in the form of a reinforcing heading. The reinforcing tape is mounted in the form of a spool onto a carriage mounted near the bottom of the frame of the tabler. The carriage is mounted for transverse movement across the frame in a straight line so as to adhesively supply one face of the reinforcing tape onto the edge of the panel suspended from the tabler. Since the carriage moves in a perfectly straight line, and since the panel is suspended on the tabler, the strip of adhesively applied tape marks the proper point at which the panel should be folded over onto itself to form the reinforced heading for a panel of the proper length.

7 Claims, 10 Drawing Figures

TAPE APPLICATOR FOR DRAPERY TABLER

CROSS REFERENCE TO RELATED APPLICATION

This application is a continuation-in-part of our previously-filed application, Ser. No. 505,619, filed Sept. 13, 1974, now abandoned, and of our previously-filed application, Ser. No. 648,166, filed Jan. 12, 1976 as a continuation in part of said earlier application and entitled, "PROCESS FOR MAKING DRAPERIES" now U.S. Pat. No. 3,996,083.

BACKGROUND OF THE INVENTION

This invention relates to a process of making draperies. More specifically, the present invention relates to the process of making a reinforced heading for draperies in which the steps of premarking, measuring, and some steps of stitching may be eliminated. Still more specifically, this invention relates to a tape applicator whereby a tape of reinforcing material, such as buckrum or Pellon, may be adhesively applied along a perfectly straight line to the lower end of a panel.

BACKGROUND OF THE PRIOR ART

The conventional procedure in manufacturing draperies is to attach, side-by-side, by means of stitching, a sufficent number of vertical widths of material to provide the desired overall widths of the main drapery panel and to finish the bottom edge of the vertical side edges in the form of a hem. Consequently, in common practice, considerable amount of time has been required to lay the widths of drapery material flat on large tables in a process called "tabling" and to make spaced measurements from the top edge of the panel to pin the hem in as the operator works from the side edge of the drapery to the other marginal side edge. A major improvement in these operations has been made by Michael Tuskos in his U.S. Pat. No. 3,438,438, in an operation referred to as "vertical tabling." As described and claimed in this patent, the panels of drapery material were positioned so that the steps of marking, hemming and pressing could be done by the use of a pivotable ironing board at the bottom. Various catch shelves were provided to mark the panels at various levels so as to provide means for the seamstresses to know where the hem should be placed. The improvement disclosed in the Tuskos U.S. Pat. No. 3,738,007, provided for the vertical suspension of the drapery panels so that the materials could be simultaneously marked and trimmed at the bottom by means of a horizontally-moving carriage, containing a scissors and marker device which would simultaneously mark and trim at a selected height therefrom to allow the seamstresses to later make the stitching for the proper hem. Tuskos, however, never realized or taught the use of his tabler for the production of reinforced headings. He was always concerned only with the hem at the bottom of the tabler. Further, other inventors did not appreciate the vertical suspension of the panel from the hem to put in the reinforcing tape for the pleatable heading. Thus, for example, John Benedetto, in U.S. Pat. No. 3,802,609, still disclosed a horizontal tabling method for adhesively securing a reinforcing tape into a drapery panel, pulled over the large horizontal table 10. Our copending application Ser. No. 648,166, filed Jan. 12, 1976, first disclosed the vertical suspension of the drapery panel from the hem end on a vertical tabler and the adhesive application of a strip of reinforcing tape to the bottom portion of said panel. This invention also taught that the portion of the panel to which the tape is applied, may be supported in a horizontal plane on a pivotable ironing board.

SUMMARY OF THE INVENTION

According to this invention, there is provided a means for automatically applying a reinforcing strip of tape to the suspended drapery panel which can be later formed into a reinforced heading. This is accomplished by means of mounting a tape applicator on a carriage mounted means near the bottom of the frame of the tabler. The carriage is mounted so as to move in a perfectly straight line across said frame so as to adhesively apply the strip of reinforcing tape to the drapery panel at the proper position for folding the remaining portion of the panel over itself so as to sandwich the tape therebetween and to form a reinforced heading. By this method, since the tabler contains retractable measuring tapes on the frame members and the suspended panel is therefore the proper length for ultimate use, it is not necessary to premeasure, to mark, or to do all of the steps that prior art workers have found necessary in order to make a reinforced drapery heading. For purposes of simplicity, this invention has been described as applied to vertical tablers. However, the tape applicator can be applied equally well to horizontal tablers. The essence of the invention is the transverse movement of the carriage across the frame of the tabler and the automatic feeding of one face of said tape from a spool journaled upon said carriage onto a panel on said tabler, the face of said tape lying in a plane parallel to the plane of the portion of the panel to which the tape is being applied. Further, the word "adhesively" has been used throughout to apply to pressure-sensitive adhesives, thermally-activated adhesives and to chemically-catalyzed adhesives and other bonding agents all well known to those skilled in the art.

BRIEF DESCRIPTION OF THE DRAWINGS

The present invention is illustrated in the accompanying drawings wherein.

DETAILED DESCRIPTION

Figures 1, 2:
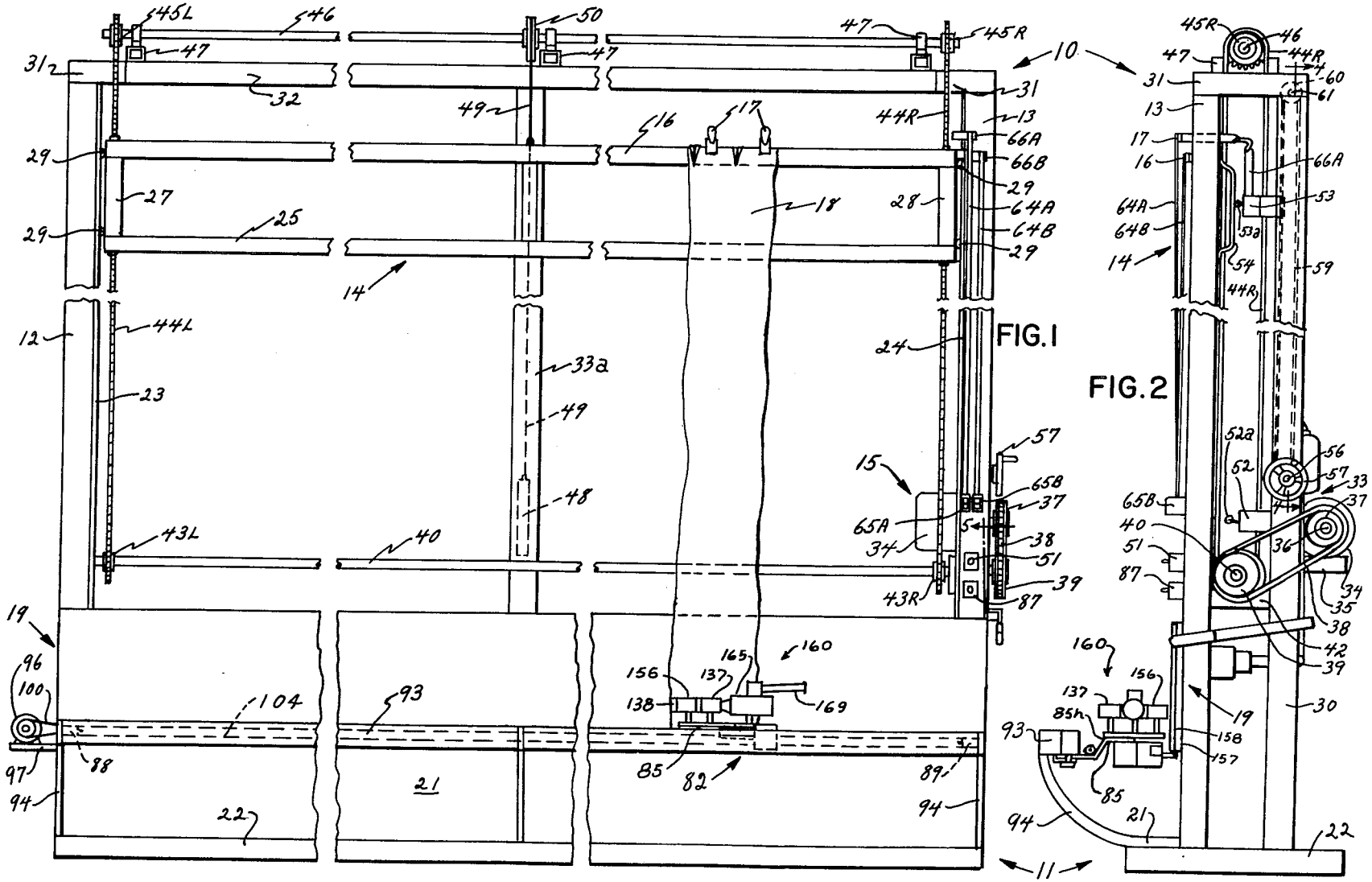
FIG. 1 is a somewhat schematic front elevational view of a tabler provided with the tape applicator means of the present invention.
FIG. 2 is a right end, elevational view of the device shown in FIG. 1.

Referring now to the drawings and more particularly to FIGS. 1 and 2, thereof, there is illustrated a vertical tabler 10, that is provided in accordance with the present invention for manufacturing draperies and the like. While it should be understood that the vertical tabler 10 could be used for other purposes, such as curtain manufacturing, etc., the description will be confined to drapes for the sake of clarity and brevity. The vertical tabler 10 is an improved form of one such as that described in detail in the Tuskos U.S. Pat. No. 3,439,438, and in U.S. Pat. No. 3,738,007. As is common to all vertical tablers on the market, the vertical tabler 10 includes an upstanding frame 11 having first and second spaced vertical plane-defining, parallel guide track mounting means 12 and 13 and a trolley 14 which transversely spans the space between the vertical members 12 and 13 and is movably connected thereto for vertical movement with respect to frame 11 by electrical motor 15. The trolley 14 is rectangular in shape and is comprised of at least one transverse member 16 which is provided with gripper means, such as a series of spring clamps 17 to grasp a panel 18 to be formed into a drapery and to vertically position the upper end of the panel 18 with respect to reference means 19 in the form of a board 157 having a rubber backing 158 spanning the lower end of the frame. A drop box 21 is also provided which spans the lower end of the frame 11 to receive the lower end of the panel 18 and to prevent it from coming into contact with the shop floor.

Vertical tracks are provided for the trolley 14 by respectively fixing a pair of channel members 23 and 24 to the vertical frame members 12 and 13 as by welding or other suitable fastening means to extend downwardly from the tops thereof. The generally rectangular shaped trolley 14 is vertically arranged on the front of the frame 11 and preferably includes a second transverse member 25 which is spaced apart from and parallel to its other transverse members 16 and thus forms its lower edge. The two transverse members, 16 and 25 of the trolley are interconnected by a pair of side members 27 and 28 and that respectively form its right and left edges. Each of these side members 27 and 28 of the trolley 10 is provided with rollers 29 that are engaged in the vertical tracks respectively, provided by the members 27 and 28.

In accordance with the present invention, the frame 11 is provided with an additional pair of vertical members, only one of which 30 is visible in the drawings, that are respectively spaced behind and in alignment with the two trolley track bearing vertical frame members 12 and 13. Each of these two rear vertical frame members, such as frame member 30, has its lower end supported by the frame base member 22 and has its upper end connected to the vertical member 12 or 13 or immediately in front of it by horizontal frame member 31 that extends fore and aft of the device 10. The fore and aft top members 31 are interconnected by another horizontal top member 32 which extends transversely between them. Yet, another vertical frame member 33 is provided that is centrally located between the two rear vertical frame members, such as the member 30 and has its lower end supported by the frame base member 22 and its upper end connected to the transverse top frame member 32.

As shown in FIGS. 1–3 and 5, drive means 15 of the of the trolley 14 comprises a reversible rotary electric motor 33 that has its housing 34 fixed to a bracket member 35 which extends horizontally and rearwardly from the right rear, vertical frame member 30 at a higher elevation of the reference means 19. Motor 33 has its rotary operated shaft 36 provided with sheave 37 which is interconnected by a belt 38 to another sheave 39 that is mounted on the right end of the trolley drive shaft 40. The trolley drive shaft 40 extends horizontally between the right and left vertical frame members 12 and 13 and is rotatably journaled in and connected thereto by bearing blocks 41 that are mounted on another pair of horizontal frame members, only one of which 42 is visible in the drawings and extend between the two pairs of front and rear vertical frame members. The trolley drive shaft 40 is provided with sprockets 43L and 43R adjacent its opposite left and right ends, and these sprockets 43L and 43R respectively connected by left and right trolley drive chains 44L and 44R to other sprockets 45L and 45R that are provided on the opposite left and right ends of the driven shaft 46. The driven trolley shaft 46 extends across the top of the frame 11 and is rotatably journaled in additional bearing blocks 47 that are fastened to the top frame member 32. One end of each of the two trolley drive chains 44L and 44R is respectively connected to the left or right bottom corner of the trolley 14, while the opposite end of each chain 44L and 44R is respectively connected to the left or right top corner of the trolley 14.

Figure 5:
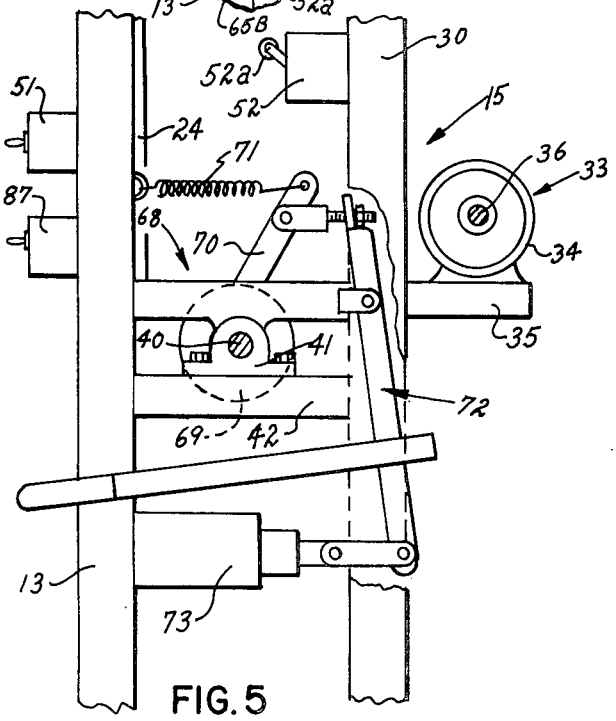
FIG. 5 is an enlarged, partially broken, fragmentary sectional view taken along lines 5—5 of FIG. 1.

With this arrangement, rotation of the motor output shaft 36 in the first direction (clockwise as shown in FIGS. 2 and 5) will cause upward movement of the trolley 14 relative to the frame 11, whereas rotation of the motor output shaft 36 in the opposite direction (counterclockwise as shown in FIGS. 2 and 5) will cause downward movement of the trolley 14. Upward movement of the trolley 14 is assisted by a counterweight 48 (shown in shadow in FIG. 1) which is connected to cable 49 which is draped over pulley 50 and is centrally connected on the driven shaft 46.

In accordance with the present invention, the vertical tabler 10 is provided with control means for de-energizing the trolley drive 15 following movement of the trolley 14 to a predetermined distance by the reference means 16. As mentioned in FIGS. 1–5, these trolley drive control means including electric toggle switch 51 for energizing the trolley drive motor 33 to rotate its output shaft 36 in either of the two opposite directions and a pair of electric limit switches 52 and 53 for controlling de-energization of that same motor 33.

The toggle switch 51 is presently physicially mounted within a housing that is fixed to the right front, vertical frame member 13 at the hand level of a typical operator, while the housing of one of the two microswitches 52 is fixed at a similar elevation on the front face of the right, rear vertical frame member 30. The first microswitch 52 has its actuator 52A arranged to extend forwardly for temporary engagement with the cam surface 54 that is fixed on the rear of the right member 28 of the trolley 14 so as to limit downward movement of the trolley 14.

The other of these two microswitches 53 serves to limit upward movement of the trolley 14 by the trolley drive means 15 and is itself mounted for vertical movement relative to the frame 11 by manually operated upper limit switch drive means 55.

The upper limit switch drive means 55 includes a horizontal drive shaft 56 that extends transversely to and is journaled for rotation in the right rear vertical frame 30 at an elevation similar to that of the toggle switch 54. This upper limit switch drive shaft 56 has a hand wheel 57 connected to its right end and carries a sprocket 58. This sprocket 58 is connected by an endless chain 59 to another sprocket 60, carried by driven shaft 61 and is rotatably journaled in the rear end of the right end of the extending top frame members 11.

Figure 3:
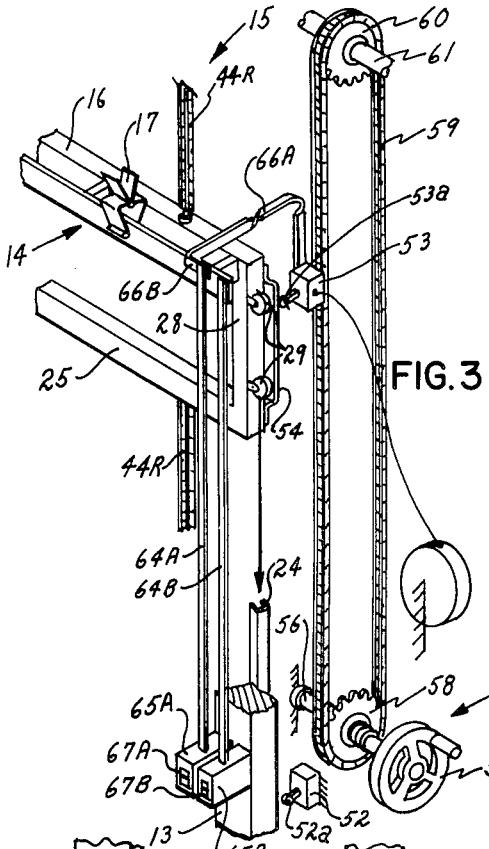
FIG. 3 is an enlarged, fragmentary, perspective view of a form of drive means for moving the trolley means of the device. with respect to its frame.

As is best shown in FIG. 3, the upper limit switch 53 has its housing fixed to a front facing surface of the endless chain 59 with its actuator 53A arranged to extend forwardly for temporary engagment with the cam surface 54 that is fixed on the right rear side of member 28 and the trolley 14 so as to limit upward movement of the trolley 14. The elevation of the upper limit switch 53 can be readily varied through manual operation of the drive means 55 by hand rotation of its hand wheel 57. Manual rotation of the hand wheel 57 in the first direction (clockwise as shown in FIGS. 2 and 3) will cause upward movement of the limit switch 53 with respect to the frame 11 and trolley 14, whereas the rotation of the hand wheel in the second direction, opposite to the first direction (counterclockwise, as shown in FIGS. 2 and 3) will cause the upper limit switch 53 to be moved downwardly with respect to the frame 11 and trolley 14.

Figure 4:
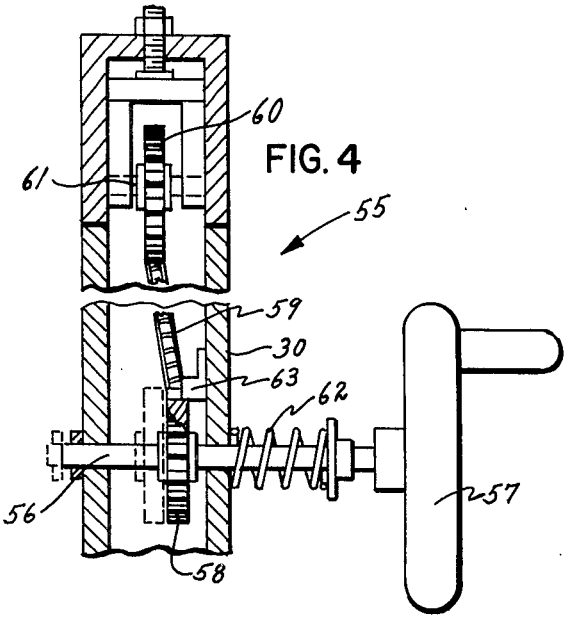
FIG. 4 is an enlarged, partially broken fragmentary sectional view, taken along lines 4—4 of FIG. 2

As shown in detail in FIG. 4, inadvertent movement of the upper limit switch drive means 55 is prevented by the provision of a spring 62 which axially surrounds its drive shaft 56 and biases the drive sprocket 58 into engagement with a stop 63 fixed on the vertical frame member 30. The sprocket 58 can of course be readily disengaged from the stop 63 by pushing the hand wheel against the force of the spring 62.

In order to facilitate accurate length measurement of the drapery panel 18 and the location of a heading at its lower end, the present invention provides the tabler 10 with measuring means comprising a pair of retractable measuring tapes 64A and 64B. Each of these measuring tapes 64A and 64B is housed in a casing, with the two casings 65A and 65B being fixed side by side on the front surface of the right front vertical frame member 13 at an identical elevation above the reference means 19. Both of these tapes 64A and 64B extend upwardly from their respective housings, with the distal end of one 64A being connected to the housing of the upper limit switch 53 by a first bracket 66A, while the distal end of the other tape 64B is connected to the upper right corner of the trolley 14 by another bracket 66B. The casings 65A and 65B for the two tapes 64A, and 64B are respectively provided with windows 67A and 67B, each having a horizontal indicator line provided thereon.

In operation, the hand wheel 57 is pushed against the spring 62 and rotated to cause the upper limit switch 53 and the distal end of the measuring tape 64A that is connected to it to be moved to a predetermined desired elevation above the reference means which will be indicated by the particular meter mark on that tape 64A which is matched up with the indicator line on the window 67A of its casing 65A. Then, subsequent operation of the toggle switch 51 will energize the trolley drive motor 33 and cause upward movement of the trolley 14 by the trolley drive means 15 until the cam surface 54 carried by the trolley 14 engages the upper limit switch actuator 53A. This upward movement of the trolley 14 will cause simultaneous upward extension of the other measuring tape 64B that is attached to it by the bracket 66B. The two tapes 64A and 64B are so interrelated to one another, the reference means 19, the trolley 14 and the upper limit switch drive chain 59 that, when upward movement of the trolley 14 is stopped by engagement to its can surface 54 with the upper limit switch actuator 53A, the meter mark on the trolley-attached tape 64B that is aligned with the indicator line on the window 67B of its casing 65B will be identical to the meter mark of the other tape 64A which was previously aligned with the indicator line on its casing window 67A through rotation of the hand wheel 57. Thus, any metered tape length that is preset at the indicator line on the window 67A of the casing 65A of the upper-limit switch-attached tape 64A through operation of the hand wheel 57 will be matched by the trolley drive means 15 and automatically stopped there by the trolley drive control means, with the equal actual matched length being indicated by the mark on the tape 64B that is then aligned with the indicator line on the window 67B of its casing 65B.

In order to avoid overriding of either of the two limit switches 52 or 53 by the trolley drive means 15, the present invention further provides disc-type brake means 68 which are best shown in FIG. 5. As illustrated, these brake means 68 include a disc 69 which surrounds and is fixed on the trolley drive shaft 40 between its belt driven sheave 39 and right drive sprocket 43R. This disc 69 is normally engaged (and rotation of the trolley drive shaft 40 prevented) by brake shoe means (not shown in detail) held in contact therewith by one end of a lever 70 which is yieldably urged into its braking position by resilient means such as a tension spring 71 that connects the opposite end of the brake lever 70 to the right front vertical frame member 13. The force of the tension spring 71 can, however, be overcome and the lever 70 operated to release the brake shoe means from the drive shaft brake disc 69 through operation of a linkage 72 by solenoid 73 that is electrically connected in the control circuit (not shown) for the trolley drive 15.

Therefore, as soon as either of the two limit switches 52 or 53 has its actuator 52A or 53A engaged by the trolley cam surface 54, both the trolley drive motors 33 and the brake releasing solenoid 73 will be simultaneously de-energized and there will be simultaneous re-engagement of the brake shoe means with the brake disc 69 with the de-energization in the trolley drive means motor 33.

In accordance with the improvement presented in the present invention, as is best shown in FIGS. 1, 2 and 6–9, the reference means 19 is in the form of a board 157 adjacent the lower end of the frame 11 of the vertical tabler 10 with respect to which the upper end of the inverted drapery panel 18 is vertically positioned by attaching the panel's lower end to the top of the trolley 14 by gripper means such as the spring clamp 17. The tape applicator means 134 and cutting means 82 are combined with the vertical tabler for respective movement relative to the horizontal reference plane defined by the rubber-backed board 157 so as to simultaneously apply a strip of buckram or Pellon from a roll 137 on the panel 18 and to simultaneously trim the lower edge of the panel along a cut 84 that is aligned with the bottom of the board 157. This improved arrangement is particularly advantageous over that described in the aforementioned Tuskos U.S. Pat. Nos. 3,439,438 and 3,738,007, in that it eliminates the need for the marking means, the ironing board and the creasing means and permits the panel 18 to be immediately folded upon itself so as to sandwich the buckram tape between the two layers of drapery panel to be secured into a reinforced heading by adhesives, by stitching or by stapling. If a thermally-active or pressure-sensitive adhesive is utilized on the other face of the tape, the ironing board can be utilized to support the heading of the drapery panel for ironing the heading and to adhesively secure the face 138 of the tape to the trimmed end of the drapery panel 18 as disclosed in our co-pending application Ser. No. 505,619.

As illustrated in FIGS. 1 and 2 and 6–9, the applicator means 134 and the cutting means 82 are both mounted on a single carriage 85 which is driven by an electrically-powered drive means 86 for horizontal movement relative to the reference means 19 at the lower end of its frame 11 across the space defined by the vertical trolley guide tracks 23 and 24 for simultaneously trimming the panel's lower edge with an electric cutting means 82 along the cut 84 while the buckram tape is being applied to the drapery panel 18 by the tape applicator means 134. Furthermore, the vertical tabler 10 is also preferably provided with control means, including another toggle switch 87, another pair of normally closed microswitches 88 and 89 for automatically de-energizing the carriage drive means 86 upon completion of each traverse of the space between the vertical trolley guide rods 23 and 24 by means of the carriage 85.

Preferably, the horizontal reference plane defined by the rubber-back board 157, acts as a pressure backing for the idler roller which presses the face 138 of the tape onto the panel 18. Further, in a preferred embodiment, the bottom of the board 157 acts as a guide for the cutting means 82 so that the panel is automatically trimmed at the proper point.

Figure 6:
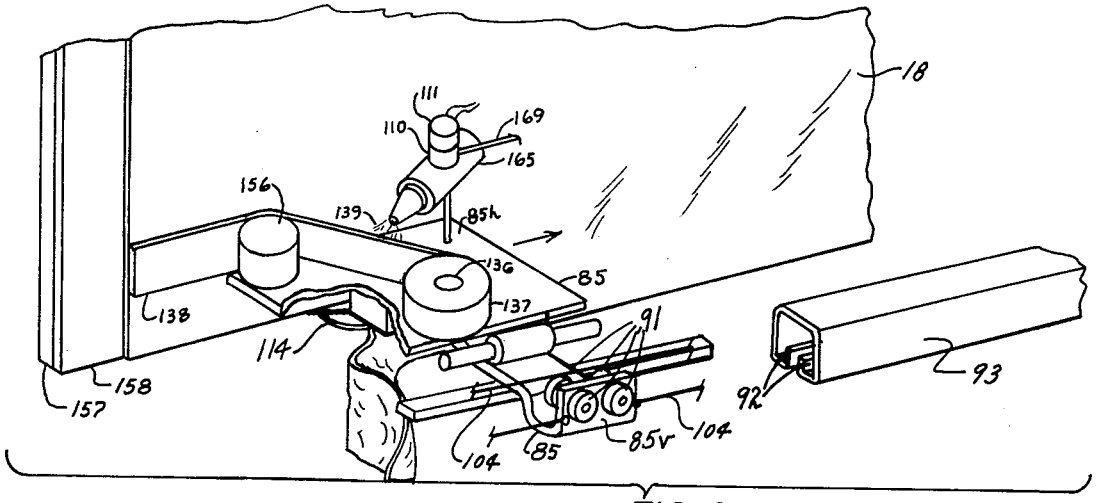
FIG. 6 is an enlarged, partially broken, fragmentary front elevational perspective view of carriage means provided in accordance with the present invention at the lower end of the frame for horizontal movement relative thereto and for tape applicator means and cutting means carried thereby.
Figure 7:
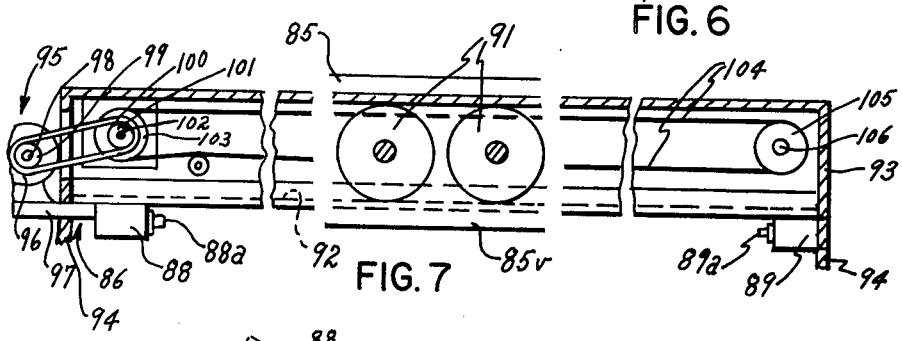
FIG. 7 is a schematic diagram of a form of drive means that can be employed to move the carriage means.
Figure 8:
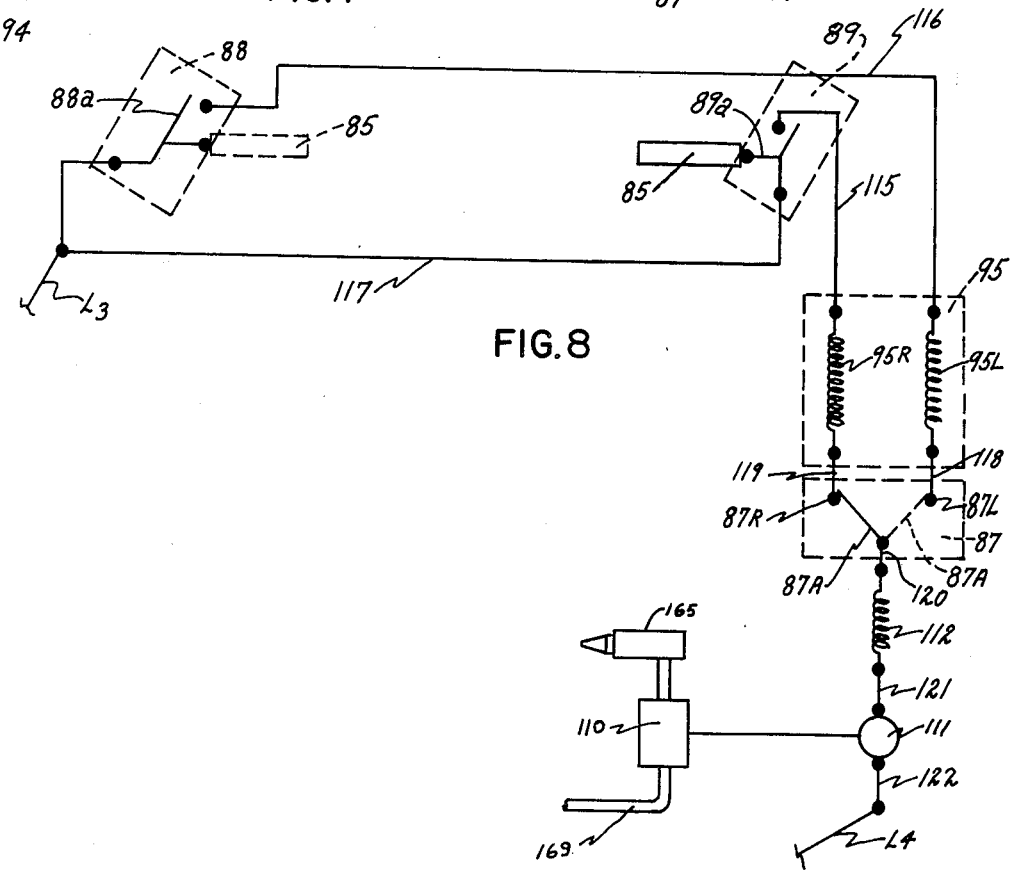
FIG. 8 is a schematic diagram of a form of electric circuit that can be utilized to control the carriage drive means.

As is shown in detail in FIG. 6, the carriage 85 comprises a plate having one of its ends, 85V hooked upwardly and provided with rollers 91, horizontally journaled thereon. The rollers 91, are, in turn, mounted for rolling movement relative to a carriage track means 92 that are formed on the lower interior of the hollow frame member 93 which is connected to and extends transversely between a pair of downwardly arched frame members 94 that are respectively connected to the bottoms of the left and right vertical frame members 12 and 13 and extend forwardly and upwardly therefrom to an elevation spaced above the horizontal reference plane 19. As shown in FIGS. 6–9, the carriage drive means 86 includes a reversible rotary electric motor 95 that has its housing 96 fixed to a bracket member 97 which is in turn connected to the left end of the carriage track forming frame member 93. The carriage drive motor 95 has its rotary output shaft 98 provided with a sheave 99 which is interconnected by a belt 100 to another sheave 101 that is mounted on one end of a carriage drive shaft 102, that is, in turn, horizontally journaled for rotation at the left end of the carriage track forming frame member 93. The carriage drive shaft 102 extends in a fore and aft direction with respect to the tabler 10, and also mounts a drive pulley 103. The carriage drive pulley 103, is, in turn, connected by a cable 104 to another pulley, 105 which is mounted on a driven shaft 106, that is journaled similarly to the carriage drive shaft 102 and located at the opposite or right end of the frame member 93. The carriage drive cable 104 has one of its ends draped around the carriage drive pulley 103 and connected to the left end of the upwardly hooked end 85V of the carriage plate 85 and has its opposite end draped around the driven pulley 105 of the carriage drive means 86 and connected to the right end of the upwardly hooked and 85V of the carriage plate 85.

With this arrangement, rotation of the carriage drive motor output shaft 98 in a first direction (counterclockwise as shown in FIGS. 1 and 6–9) will cause the carriage 85, to be moved in a first direction, from right to left (as shown in FIGS. 1 and 6–9) whereas rotation of the carriage drive motor output shaft 98 in a second direction opposite to the first (clockwise as shown in FIGS. 1 and 7–9) will cause the carriage 85 to be moved in an opposite direction with reference to the frame 11 and with reference means 19 (from left to right as shown in FIGS. 1 and 6–9).

Figure 9:
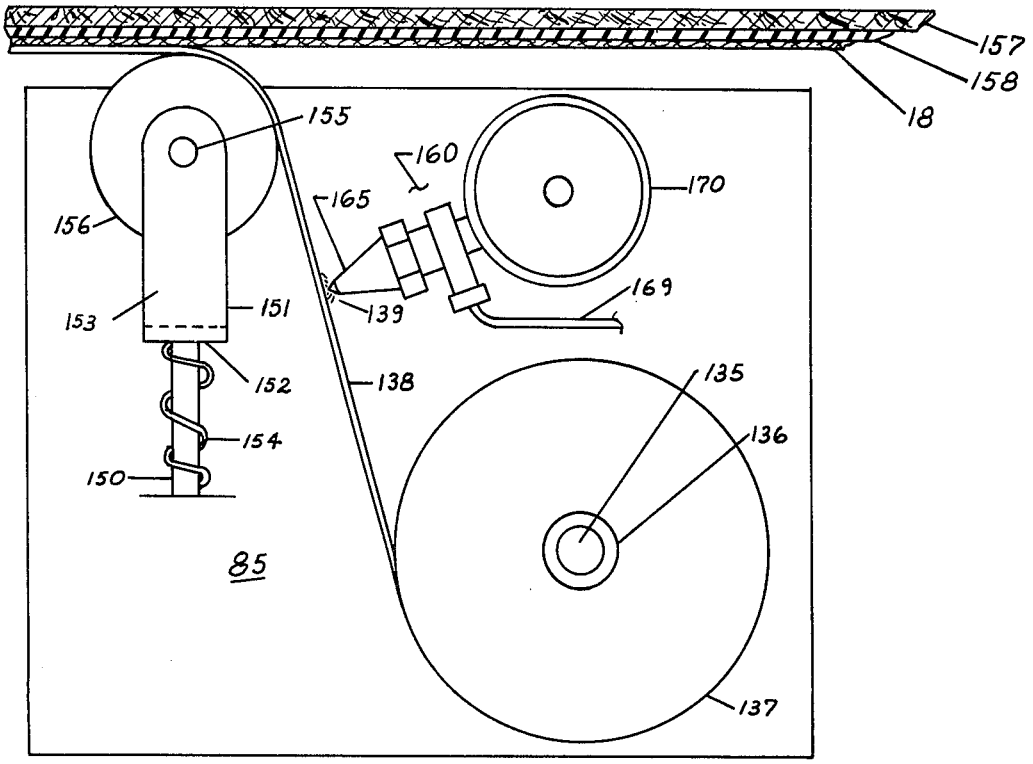
FIG. 9 is an enlarged fragmentary plan view, with parts in section, illustrating in detail the tape applicator of this invention is use in applying a tape of buckram to the drapery panel

As further shown in FIGS. 1 and 2 and 6–9, the carriage plate has a tape applicator means 134 mounted thereon in the form of a spindle 135 onto which is journaled a spool 136 containing a buckram roll 137. As is shown, the face 138 of the buckram tape is applied to the drapery panel 18 by pressure idler or applicator roll 156 against the rubber backing 158 of pressure board 157. As the face 138 of the buckram approaches the panel 18, adhesive 139 from the adhesive applicator 160, is applied thereto. As is best shown in FIGS. 6 and 9, in one embodiment this is in the form of a spray nozzle, 165 mounted on upright post 166. An air hose, 169, supplies compressed air from a source (not shown), said air hose being connected to the spray nozzle by means of a normally closed valve 110 operated by an electric solenoid 111.

As is further shown in detail in FIGS. 1 and 2 and 6–9, the cutting means 82 comprises an electrically powered scissors which includes an electric motor, having a winding 112 that is contained within a housing 113 mounted on the bottom of the rearwardly-extending **85*h* of carriage 85. The scissors further include blades 114 that are aligned with the lower horizontal reference plane comprising the bottom of the pressure board 157**.

As shown in FIGS. 1, 2 and 6–9, the carriage drive toggle switch 87 is preferably mounted on the front side of the front, right vertical frame member 13, just below the trolley drive means toggle switch 51 and the two carriage drive microswitches 88 and 89 are respectively mounted adjacent the left and right ends of the carriage drive forming member 93 to form left and right limit switches. As is illustrated in detail in the circuit diagram of FIG. 8, the reversible carriage drive motor 95 includes a pair of windings 95L and 95R, one of which, 95L, is operable when energized to drive its rotary output shaft 98 in a first direction, causing leftward movement of the carriage 85 with respect to the frame 11 and reference means 19 and the other of which, 95, is operable when energized to cause its rotary operated shaft 98 to rotate in the opposite direction and cause the carriage to be moved rightwardly with respect to frame 11 and reference means 19. As shown, the power source for the carriage drive control means comprises another pair of electric power lines L3 and L4. The motor right winding 95R is connected in electrical series with the right limit switch 89 by conductor 115 while the left winding 95L is connected in electrical series with the left limit switch 88 by another conductor 116. The series connected right winding 95R and right limit switch 89 are connected in electrical parallel with the series connected left winding 95L and left limit switch 88 by another conductor 117 to the power line L3. These two electrical paralleled circuits are respectfully connected by conductor 118 and 119 to the fixed poles 87L and 87R of the carriage toggle switch 87 which also has its movable actuator 87A connected in electrical series with a cutting means motor coil 112 on the operating solenoid 11 for the compressed air inlet valve 110 of the spray nozzle, 165 and the other power line L4 by conductors 120, 121 and 122.

Thus, assuming that trolley 14 is in its desired upwardmost position, as shown in FIG. 1, and the carriage 85 is in its left position, with the left end of its upturned front end 85V engaged in and opening the actuator 88A of the left limit switch 88, the carriage drive means 86 can only be energized and the solenoid tape applicator means 134 and the cutter drive means energized simultaneously therewith, by moving the carriage toggle switch actuator 87A from its first left position shown in shadow lines in FIG. 9 where it engages one of the fixed poles 87L of the toggle switch 87 to its first right position shown in full lines in FIG. 9 where it is engaged with the other fixed pole 87R and consequently disengaged from the first fixed pole 87L of the carriage toggle switch 87. This movement of the toggle switch will continue to cause energization of the carriage drive means motor winding 95R and the spray nozzle 165 and the cutter means 82 and rightward movement of the carriage 85 until the carriage 85 completes its traverse of the space between the vertical guide tracks 23 and 24. Then, the actuator 89A of the right limit switch 89 will be engaged and opened by the right end of the roller provided end 85V of the carriage 85, to thus simultaneously de-energize the carriage drive motor 95, the cutting means winding 112 and the solenoid 111 for the compressed air supply 110 for the spray nozzle 165. At this point, the buckram tape is cut and the carriage returned to the first position for the next panel.

Figure 10:
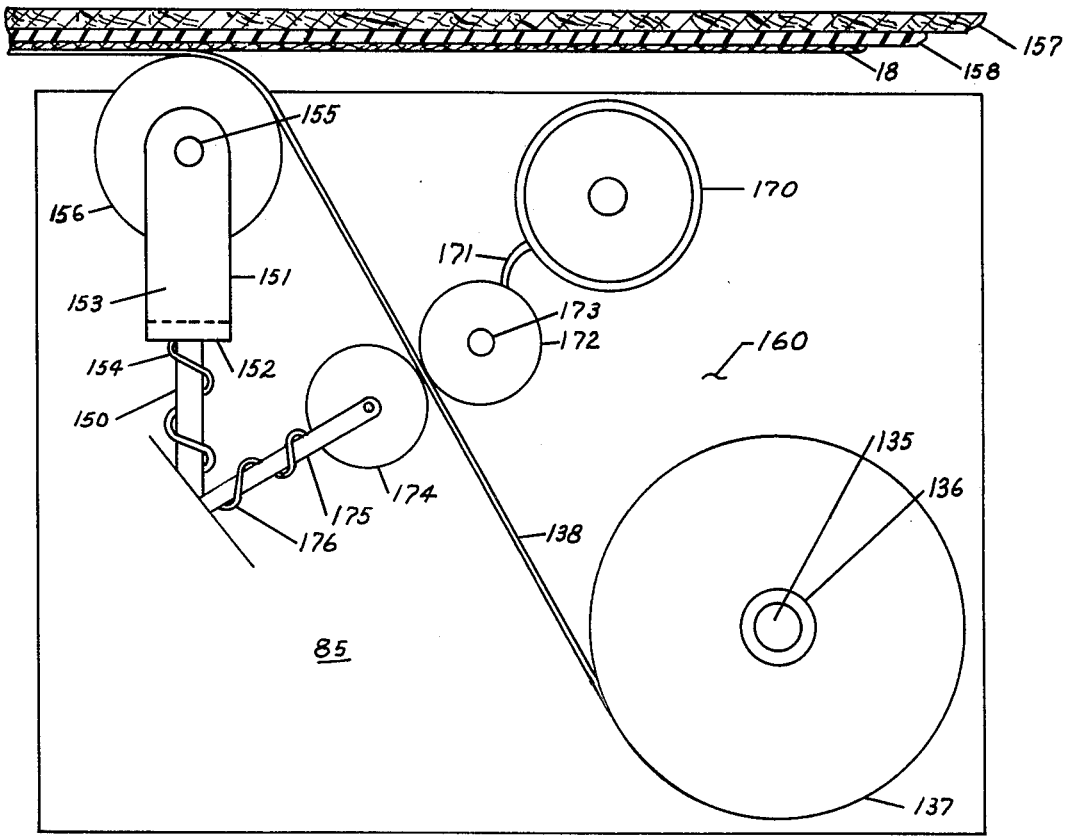
FIG. 10 is a fragmentary, enlarged, partially diagrammatic plan view illustrating in detail another modification for applying adhesive to one side of the tape as it is being applied to the drapery panel.

Referring now to FIG. 10, another modification of the adhesive applicator 160 is shown. In this case, the roll of buckram 137 on spool 136 is again suspended on the spindle 135 of carriage 85. The face of the tape, 138, is rolled between an adhesive applicator roll 172 which is held in position against the pressure roller 174 again journaled on bracket 175 and biased into position by spring 176. The roll for the adhesive roller is fed from a standard adhesive reservoir 170 by means of feed tube 171 and the buckram tape with the glue supplied is fed between the idler roller 156 and the rubber backing 158 of pressure board 157 to be applied to the drapery panel 18.

Further, it is within the scope of this invention to utilize pressure-sensitive tape disclosed in our co-pending application Ser. No. 648,146. In this case, all that is necessary is mount the buckram roll onto the spindle 135, to pull loose the release member from the pressure-sensitive area and apply the release member to a hook or other device on the frame and thereafter energize the carriage for transverse movement by means of a toggle switch, previously indicated. In this manner, the release member is stripped from the tape as the carriage moves transversely across the frame. At the end of the traverse, the tape is again cut and the carriage is moved back to its first position for application of tape to the next panel to be mounted on the device.

Further, it is within the scope of this invention, to support the panel or a portion thereof in a horizontal plane and to position the carriage with the spool of tape journaled thereof for transverse movement across the panel in a perfectly straight line so as to feed one face of the tape in a plane parallel to the plane of the portion of the panel to which the tape is being applied onto said panel so as to bond the tape thereto. The essence of the invention, then, is the transverse movement in a perfectly straight line of the carriage and of the spool of tape mounted on said carriage across the panel suspended on a tabler, and the automatic feeding of one face of said tape onto said panel in a plane parallel to the plane of the portion of the panel to which the tape is being applied.

As previously mentioned, it is within the province of this invention to utilize a tape containing pressure-sensitive tape on both sides, so that the trimmed end of the drapery panel 18 can be folded up onto the other face of the pressure-sensitive tape for sandwiching the tape between the two layers of drapery. With the tape temporarily or permanently bonded to both layers of the panel, it is not necessary to stich the tape into the panel. Since some panels are as much as 20 feet in width, the elimination of this horizontal stitching operation is a major labor-saving advantage. The panel, therefore, can be taken directly to the pleating operation where the vertical stitches, forming the pleats, are placed into the reinforced heading. These pleats are sufficient to permanently secure the tape into the reinforced heading.

Many modifications will occur to those skilled in the art from the detailed description hereinabove given and such is meant to be illustrative in nature and non-limiting so as to be commensurate in scope with the appended claims.

We claim:

1. A drapery manufacturing device, including:

A. a frame, having first and second spaced, plane-defining, parallel guide tracks;

B. a trolley, transversely spanning said tracks and movably connected thereto with respect to said frame and including a transverse member;

C. means on said transverse member of said trolley to grasp the hem edge of a panel to be formed into a drapery and to hold said panel in a plane on movement of said trolley with respect to said frame;

D. drive means to move said trolley with respect to said frame; and

E. reference means defining a reference plane adjacent to the lower end of said frame, F. the improvement of a tape applicator means mounted adjacent to the lower end of said frame for transverse movement relative to said frame to adhesively apply one face of a reinforcing tape along the lower portion of said drapery panel so that said drapery panel may be folded over on itself along the line formed by said tape in such manner that said tape is sandwiched between the two layers of said panel to be secured to said layers of said panel and form a reinforced heading for said drapery panel.

2. The invention of claim 1, wherein said applicator means is carried by a carriage means, mounted on said lower end of said frame for transverse movement relative thereto.

3. A drapery manufacturing device, as defined in claim 1, in which,

A. said tape applicator comprises a carriage mounted for transverse movement across said frame;

B. a spindle on said frame for rotatively mounting a spool of reinforcing tape; and C. adhesive means for applying one face of tape from said spool onto the said drapery panel at a prescribed point.

4. A drapery manufacturing device, as defined in claim 3, in which said carriage is disposed at a plane normal to the plane of the drapery panel to which the tape is applied.

5. A drapery manufacturing device, as defined in claim 3, in which said adhesive means comprises a spray nozzle mounted to said carriage for application of adhesive to one face of the tape being fed from said spool.

6. A drapery manufacturing device, as defined in claim 3, in which said tape applicator comprises an idler roller mounted onto said carriage for application of pressure to the tape being applied to said drapery panel.

7. A drapery manufacturing device, as defined in claim 6, the further combination therewith of a pressure board mounted behind said drapery panel to support said drapery panel as the tape is adhesively applied thereto.

* * * * *